US012760508B2

(12) United States Patent
Ray et al.

(10) Patent No.: US 12,760,508 B2
(45) Date of Patent: Oct. 13, 2026

(54) WATER STORAGE SYSTEM

(71) Applicant: DeepRoot Green Infrastructure, LLC, San Francisco, CA (US)

(72) Inventors: Charles Graham Ray, Mill Valley, CA (US); Patrick Brien Greeley, Hopkins, MN (US); Jeffrey Shawn Freedberg, Kensington, CA (US); John Joseph Cogger, Santa Ana, CA (US)

(73) Assignee: DeepRoot Green Infrastructure, LLC, San Francisco, CA (US)

( * ) Notice: Subject to any disclaimer, the term of this patent is extended or adjusted under 35 U.S.C. 154(b) by 8 days.

(21) Appl. No.: 18/100,266

(22) Filed: Jan. 23, 2023

(65) Prior Publication Data

US 2024/0247475 A1 Jul. 25, 2024

(51) Int. Cl.
*E03F 1/00* (2006.01)

(52) U.S. Cl.
CPC ..... *E03F 1/005* (2013.01)

(58) Field of Classification Search
CPC ..... E02F 1/005; E03F 3/046; E03F 5/0408; E03F 1/002; E03F 1/005; E03F 1/00; E03F 5/101; A01G 13/0237; A01G 27/006; E01C 3/006; E01C 5/001; E01C 9/005; E01C 2201/00; E01C 2201/20; E01C 2201/207; E02B 11/005; Y10T 137/598; Y02A 10/30; Y02A 20/40
See application file for complete search history.

(56) References Cited

U.S. PATENT DOCUMENTS 360,168 A * 3/1887 McMahon ..... F16L 13/122 285/285.1
1,123,888 A * 1/1915 Kempf ..... E03F 1/003 137/247.33
1,564,927 A * 12/1925 Ballard ..... E02B 13/02 73/216
2,455,470 A * 12/1948 Collison ..... E03C 1/122 285/148.23

(Continued)

FOREIGN PATENT DOCUMENTS

CN 102165910 A 8/2011
CN 110409558 A 11/2019

(Continued)

OTHER PUBLICATIONS

International Search Report and Written Opinion for International Application No. PCT/US24/11974, mailed Apr. 30, 2024, 08 Pages.

(Continued)

*Primary Examiner* — Edwin J Toledo-Duran
(74) *Attorney, Agent, or Firm* — DLA Piper LLP (US)

(57) ABSTRACT

Embodiments of the present disclosure relate to a water storage system that can include a water storage unit and a water storage lid configured to be attached to the water storage unit. The water storage system can include an outer shell with a first side comprising a first plurality of openings and a second side adjacent the first side comprising a second plurality of openings; a first set of cross-bodies spanning a width of the outer shell; and a second set of cross-bodies spanning a length of the outer shell and intersecting the first set of cross-bodies.

17 Claims, 22 Drawing Sheets

(56) References Cited

U.S. PATENT DOCUMENTS 2,547,567 A * 4/1951 Collison ..... E03C 1/122 285/148.23
4,298,470 A * 11/1981 Stallings ..... E03F 11/00 137/577
4,522,533 A * 6/1985 Campbell ..... F16L 55/027 138/44
4,756,827 A * 7/1988 Mayer ..... E03F 1/002 137/577
5,051,028 A * 9/1991 Houck ..... F16L 1/06 405/50
5,437,698 A * 8/1995 Furukawa ..... E03F 1/005 52/302.1
5,509,244 A * 4/1996 Bentzon ..... E01C 5/005 428/44
5,639,364 A * 6/1997 Houck ..... E02B 11/00 405/35
5,680,989 A * 10/1997 Plachy ..... F16K 3/0254 137/577
5,810,510 A * 9/1998 Urriola ..... E02B 11/005 210/170.03
5,916,104 A * 6/1999 Lucenet ..... E02B 11/00 52/794.1
6,132,603 A * 10/2000 Mokrzycki ..... B01D 21/2433 210/170.03
6,602,023 B2 * 8/2003 Crescenzi ..... E03F 1/003 405/48
6,694,672 B1 * 2/2004 Hergeth ..... E01C 13/083 47/65.9
6,772,789 B1 * 8/2004 Terry, III ..... E03F 5/105 137/577
6,779,946 B1 * 8/2004 Urriola ..... E01C 11/228 405/36
7,677,835 B2 * 3/2010 Oscar ..... B65D 90/027 405/39
7,704,011 B2 * 4/2010 Marshall ..... E02D 27/02 404/34
8,555,586 B2 10/2013 Lowe et al.
8,602,681 B1 * 12/2013 Masser ..... E03F 1/005 405/43
8,790,037 B2 * 7/2014 Culleton ..... E01C 3/006 404/34
9,206,574 B2 12/2015 Parker
9,303,365 B2 * 4/2016 Gooden ..... E01C 23/00
9,506,235 B2 11/2016 Adams et al.
9,708,806 B2 * 7/2017 Meincke ..... E03F 1/005
9,896,832 B2 * 2/2018 Graf ..... E03F 1/005
9,957,987 B2 * 5/2018 Wandkowski ..... E02B 11/00
10,718,090 B2 * 7/2020 van Raam ..... E03F 1/005
10,808,392 B2 10/2020 Bhatia et al.
11,851,867 B1 * 12/2023 Holbrook ..... E03F 1/005
11,933,033 B2 * 3/2024 Larach ..... E03F 1/005
11,980,835 B2 * 5/2024 Zarraonandia ..... B01D 29/33
12,286,782 B2 * 4/2025 Miller ..... E03F 1/005
2003/0188505 A1 * 10/2003 Marshall ..... E02D 27/02 52/606
2005/0155285 A1 * 7/2005 Urban ..... A01G 13/27 47/32.7
2007/0028514 A1 * 2/2007 Urban ..... E03F 1/005 47/48.5
2007/0181197 A1 * 8/2007 Krichten ..... E03F 1/005 137/833
2007/0274776 A1 * 11/2007 Urriola ..... E01C 9/004 403/364
2008/0044231 A1 * 2/2008 Roelfsema ..... E03F 1/005 425/149
2008/0166182 A1 * 7/2008 Smith ..... E03F 1/005 405/36
2009/0250369 A1 * 10/2009 Guibert ..... E03F 1/002 220/608
2010/0200600 A1 * 8/2010 Hoekstra ..... E03F 1/005 220/676
2011/0108559 A1 * 5/2011 Hewing ..... E03F 1/005 220/694
2012/0141203 A1 * 6/2012 Gooden ..... A01G 13/27 404/41
2012/0255624 A1 * 10/2012 Canney ..... E02B 11/005 137/315.01
2013/0284750 A1 * 10/2013 Takai ..... E03F 1/005 220/651
2014/0105684 A1 * 4/2014 Allard ..... E02B 11/00 405/52
2014/0138307 A1 * 5/2014 Coffman ..... C02F 3/327 210/170.03
2014/0291221 A1 * 10/2014 Adams ..... E03F 3/046 210/170.03
2014/0294508 A1 * 10/2014 Parker ..... E02B 11/005 405/45
2016/0295812 A1 * 10/2016 Ray ..... E01C 3/06
2017/0292259 A1 * 10/2017 Van Der Scheer ..... E03F 1/005
2017/0292260 A1 * 10/2017 Van Der Scheer ..... E03F 1/005
2020/0032500 A1 1/2020 Bhatia et al.
2021/0388581 A1 * 12/2021 Messerschmidt ..... E03F 1/005
2023/0056371 A1 2/2023 Larach

FOREIGN PATENT DOCUMENTS

WO 2008009879 1/2008
WO 2017217853 12/2017

OTHER PUBLICATIONS

International Search Report and Written Opinion for Application No. PCT/US2025/028898, mailed on Jul. 23, 2025, 12 pages.

* cited by examiner

WATER STORAGE SYSTEM

BACKGROUND OF THE DISCLOSURE

Various techniques are involved for managing stormwater. Generally, in less developed areas, most stormwater is absorbed into the soil, where it is filtered and stored until it ultimately flows back into streams, rivers, or lakes. Occasionally it can replenish aquifers or other water sources, as well. However, in urban environments where much of the land surface is covered by hardscape, various problems can arise from stormwater. Hardscape (e.g., pavement) can prevent stormwater from naturally soaking into the ground, instead causing it to rapidly move into storm drains, sewer systems, drainage ditches etc. Resulting issues can therefore include flooding, stream bank erosion, habitat destruction, sewer system overflows, infrastructure damage, and more. In addition, sometimes it is desired to retain stormwater in urban environments, but the hardscape makes this difficult by causing it to run quickly off the hard surface and into lakes or other places where the stormwater becomes inaccessible.

SUMMARY OF THE DISCLOSURE

According to one embodiment of the present disclosure, a water storage system can include a water storage unit and a water storage lid configured to be attached to the water storage unit. The water storage unit can include an outer shell with a first side comprising a first plurality of openings and a second side adjacent the first side comprising a second plurality of openings; a first set of cross-bodies spanning a width of the outer shell; and a second set of cross-bodies spanning a length of the outer shell and intersecting the first set of cross-bodies.

In some embodiments, the outer shell can include a third side comprising a third plurality of openings, wherein the third side is opposite the first side and the third plurality of openings are aligned with the first plurality of openings; and a fourth side comprising a fourth plurality of openings, wherein the fourth side is opposite the second side and the fourth plurality of openings are aligned with the second plurality of openings. In some embodiments, at least one of the first side or second side can include a plurality of secondary openings, wherein each secondary opening is between an opening and a corner of the outer shell. In some embodiments, each of the plurality of secondary openings are approximately rectangular in shape.

In some embodiments, the water storage lid can include a plurality of perforations. In some embodiments, each of the plurality of perforations are hexagonally shaped. In some embodiments, the water storage lid can include a plurality of flaps configured to cover a portion of the outer shell. In some embodiments, the water storage unit can include a plurality of vertical pillars, the pillars supporting intersection points of the first and second sets of cross-bodies. In some embodiments, each intersection point can include a male connection mechanism. In some embodiments, the male connection mechanism can include a plurality of prongs. In some embodiments, the male connection mechanism can include four prongs. In some embodiments, the lid can include a plurality of female connection mechanisms. In some embodiments, the female connection mechanisms are aligned with the male connection mechanisms. In some embodiments, each of the female connection mechanisms can include a plurality of slots, each slot being configured to receive a prong of a respective male connection mechanism.

In some embodiments, each of the first and second pluralities of openings can be circular. In some embodiments, each of the first and second pluralities of openings can have a diameter of about 128 mm. In some embodiments, the water storage system can include at least one flow restrictor configured to block an opening. In some embodiments, the at least one flow restrictor is slotted. In some embodiments, the water storage system can include a second water storage unit connected to a bottom of the first water storage unit. In some embodiments, each of the first and second pluralities of openings can include two openings.

DESCRIPTION

The following detailed description is merely exemplary in nature and is not intended to limit the invention or the applications of its use.

Embodiments of the present disclosure relate to a water storage unit and assembly thereof that can operate as both a support structure for hardscape needs and a water storage system. The system of the present disclosure offers increased flexibility and modularity by using a single water storage unit as a base or building block to form larger assemblies. The water storage units are therefore stackable on another, and this "stackability" provides great flexibility. These larger assemblies can reside underneath and support various hardscape structures, such as streets, sidewalks, parking lots, and other hardscape applications that bear high-loads, etc. An individual water storage unit of the present disclosure can include a lid with various perforations that allow water (i.e., stormwater) to pass through the lid and into the main body of the water storage unit(s), where it can be stored. Such an ability to detain water enables various other uses of the stormwater, such as wicking for reuse, irrigation, and to meet and comply with various EPA standards. The individual water storage units can include various openings on each vertical side, which enable pipes, drainage lines, and other components to run through the unit. Other components can include utility lines, fiber optics cables, internet cables, gas lines, and the like. In addition, in an assembly with multiple water storage units stacked and assembled, the openings provide many options and angles for allowing pipes and other components to run through the assembly. Finally, the disclosed water storage assembly can utilize various plugs (herein referred to as flow restrictors) that are configured to fit inside the openings, thus blocking water from flowing through the opening. This provides greater flexibility and controlled release of the water storage system. For example, one or more entire sides of an assembly may be blocked with flow restrictors, forcing water to enter and exit from the two non-blocked sides. In this manner, the ingress and egress of water through the system can be effectively controlled and monitored. In some embodiments, a soil media or filler media can be used to fill the disclosed water storage units, such as bioretention soil. This can enable the growth of trees and other vegetation. The disclosed water storage unit can be comprised of polypropylene (e.g., fully recycled polypropylene) or various other materials which are application dependent.

Figure 1A:
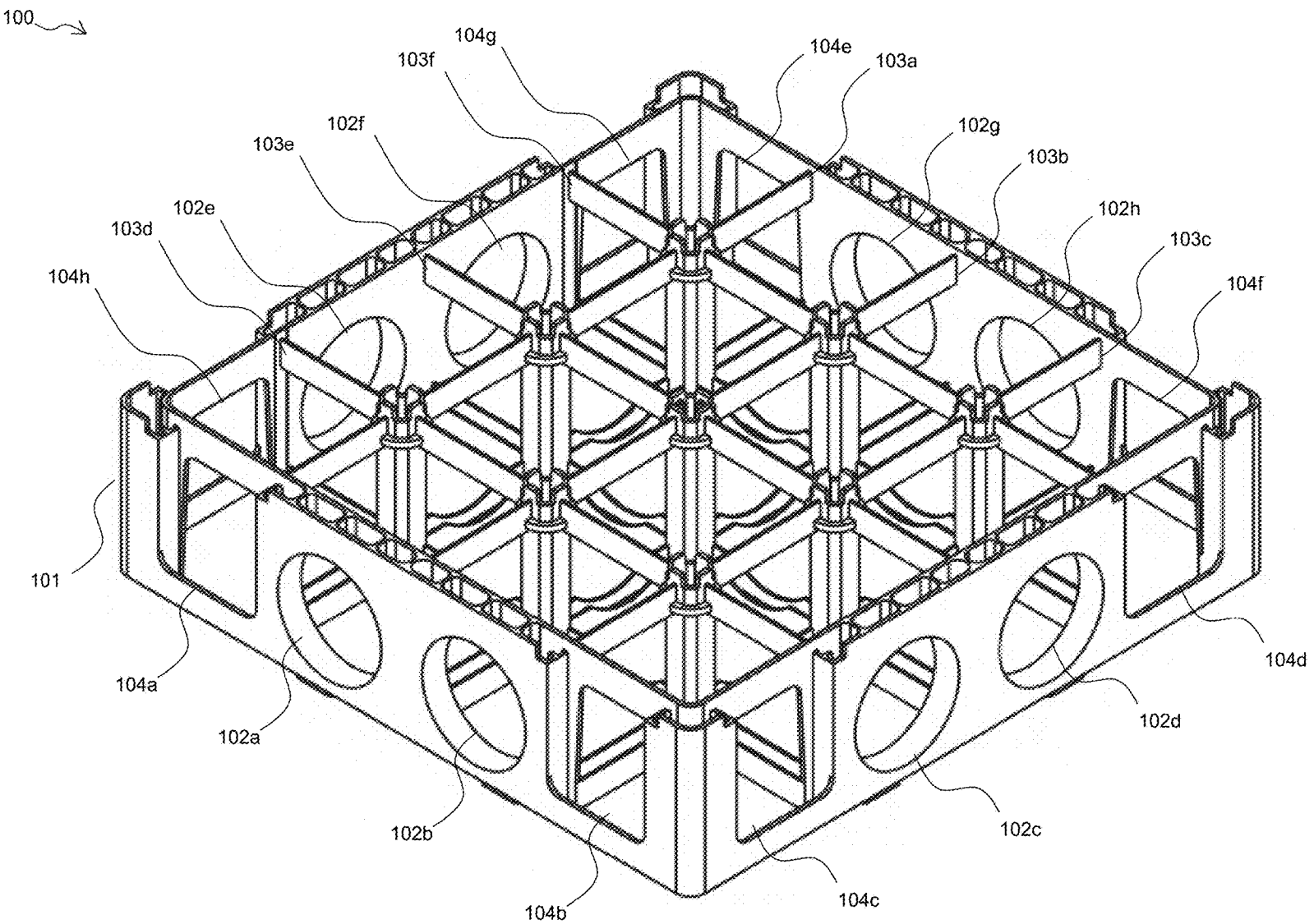
FIG. 1A shows a perspective view of a water storage unit according to some embodiments of the present disclosure.

FIG. 1A shows a perspective view of a water storage unit 100 according to some embodiments of the present disclosure. A water storage unit 100 can be used as a base or building block to form a water storage assembly (see FIGS. 4A-6B). The water storage unit 100 includes an outer shell 101. In addition, the water storage unit 100 can include various openings 102*a-h* (herein referred to as an "opening 102" generally or "openings 102" collectively) in the outer shell 101, which are configured to allow various piping, cables, lines, etc. to pass through them, substantially increasing the size and quantity of lines that can run through the unit 100, thus increasing the flexibility and efficiency in which the unit 100 can operate within the surrounding infrastructure. In some embodiments, the water storage unit 100 can include a plurality of openings 102 on each side of the outer shell 101, where the openings 102 of opposite sides are co-radial or concentric but in different planes. For example, the water storage unit 100 of FIG. 1A includes two openings 102 on each side of the outer shell 101, where openings 102*a-b* are concentric with openings 102*g-h* and openings 102*c-d* are concentric with openings 102*e-f*. In addition, the water storage unit 100 includes various cross-bodies 103*a-f* (herein referred to as a "cross-body 103" generally or "cross-bodies 103" collectively). The cross-bodies 103 can connect opposite sides of the outer shell 101 (i.e., spanning the width of the outer shell 101). In addition, when the water storage unit 100 includes multiple sets of parallel cross-bodies 103, the two sets can intersect perpendicularly. In some embodiments, each opening 102 can reside between two cross-bodies 103. In some embodiments, the opening 102 can reside midway between the two cross-bodies 103. At each intersection of cross-bodies 103, a vertical pillar can support the intersection point. These pillars and the cross-bodies 103 can form a sort of lattice within the interior of the water storage unit 100. In some embodiments, the water storage unit 100 can also include one or more secondary openings 104 on each side of the outer shell 101. For example, in FIG. 1A, each side includes a secondary opening 104 that is between an opening 102 and the nearest corner of the outer shell 101. In some embodiments, secondary openings 104 are optional, but may reduce the amount of required material to build the water storage unit 100 while maintaining sufficient structural integrity to support a hardscape and any weight thereon. In some embodiments, the secondary openings 104 can be approximately rectangular in shape, although this is not limiting.

Figure 1B:
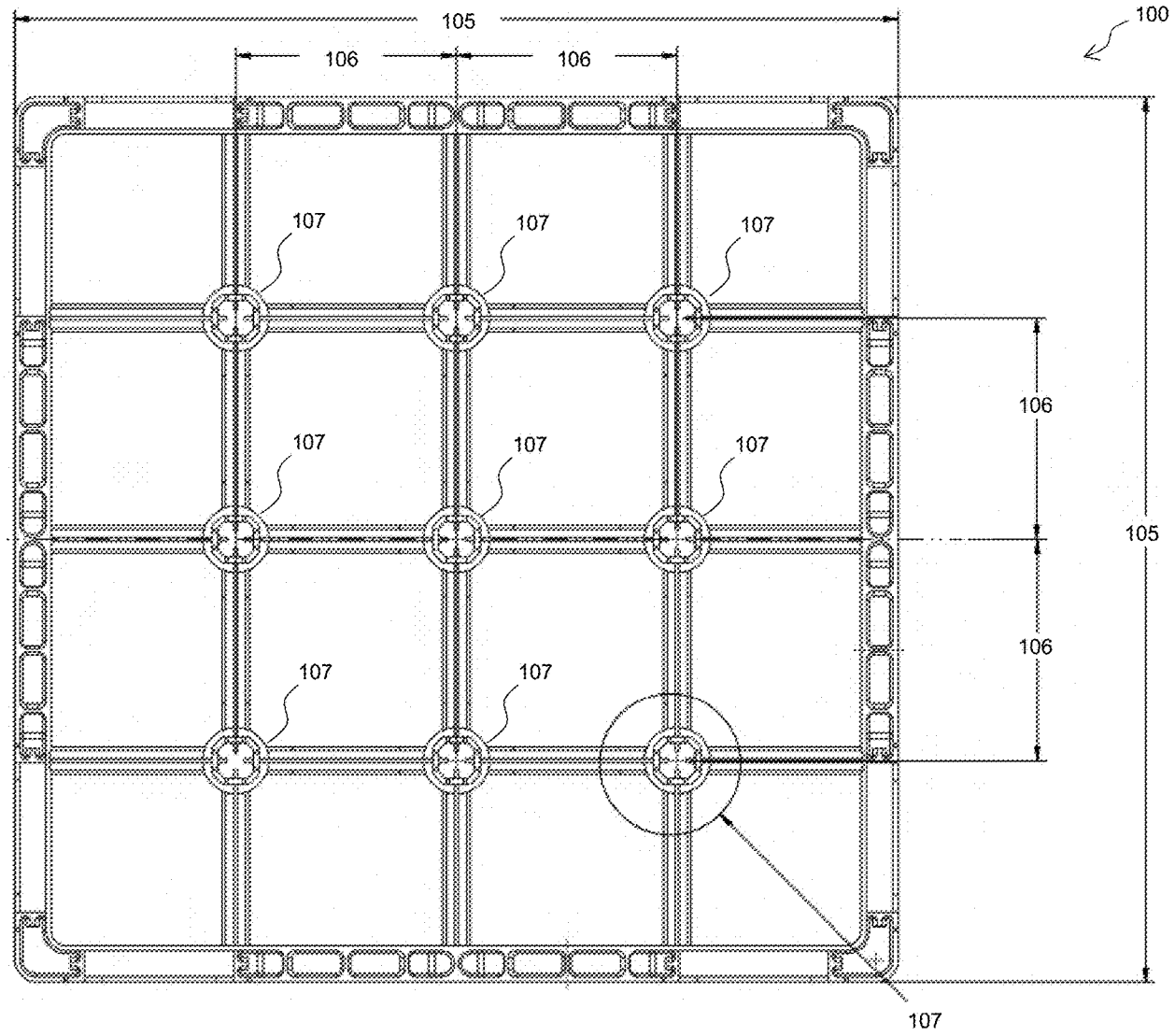
FIG. 1B shows a top view of a water storage unit according to some embodiments of the present disclosure.

FIG. 1B shows a top view of a water storage unit 100 according to some embodiments of the present disclosure. The water storage unit 100 includes a width 105 and length 105, which are equal in this embodiment and can be about 600 mm. In other embodiments, the water storage unit 100 may not be a square and the width and length may not be equal. In addition, the water storage unit 100 includes a distance 106 between each cross-body 103. In some embodiments, the distance 106 can be about 150 mm. It is important to note that, while the distances 106 in the disclosed embodiments are equal, this is not a requirement. In addition, the water storage unit 100 includes a plurality of intersection points that include a male connection mechanism 107. The male connection mechanisms 107 can be configured to attach to a lid (see FIGS. 3A-3B) or to other water storage units 100. Additional details regarding the male connection mechanism 107 are discussed in relation to FIG. 1D.

Figure 1C:
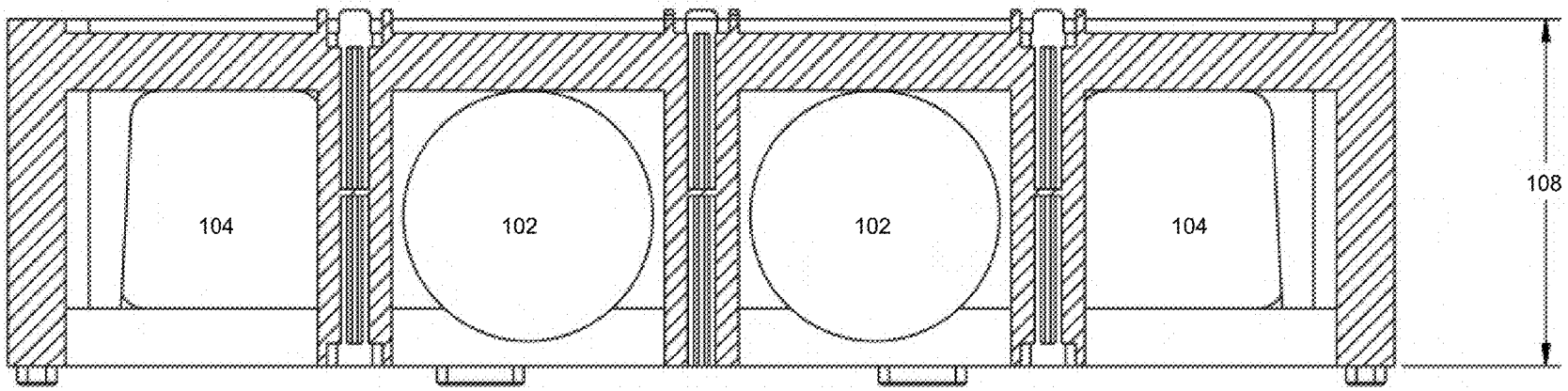
FIG. 1C shows a side view of a water storage unit according to some embodiments of the present disclosure.

FIG. 1C shows a side view of a water storage unit 100 according to some embodiments of the present disclosure. From the side, the two openings 102 and the two secondary openings 104 are visible. Water storage unit 100 can have a height 108, which is about 150 mm. In some embodiments, the openings 102 can have a diameter of about 128 mm or less.

Figure 1D:
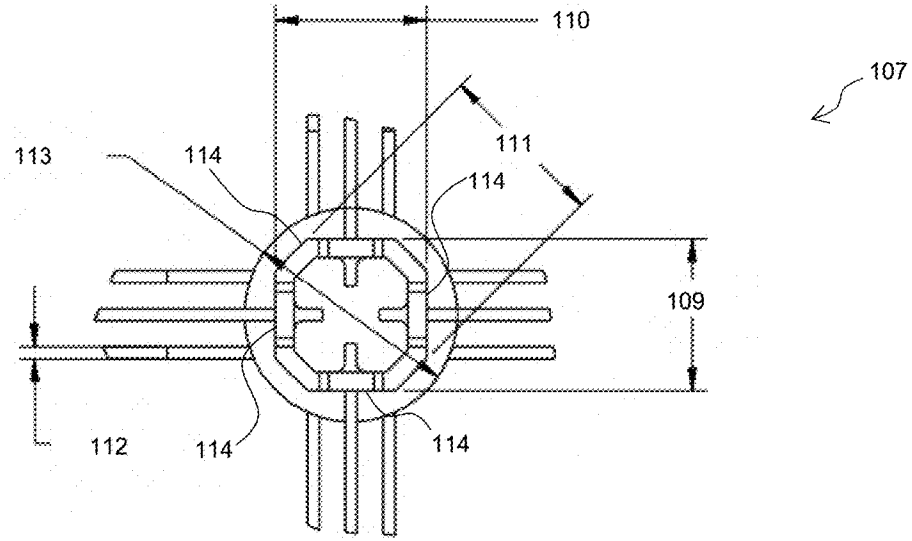
FIG. 1D shows a male connection mechanism of a water storage unit according to some embodiments of the present disclosure.

FIG. 1D shows a male connection mechanism 107 of a water storage unit 100 according to some embodiments of the present disclosure. In some embodiments, the male connection mechanism 107 can include four prongs 114. The prongs 114 can be used to attach the water storage unit 100 to other a lid or other water storage units. In addition, the male connection mechanism 107 can include a length 109 and a width 110. In some embodiments, the length 109 and width 110 can be equal and can be about 32 mm. In addition, the male connection mechanism 107 can include a diagonal width 111, which can be about 36 mm. The male connection mechanism 107 can also include a thickness 112 of about 2.5 mm and a diameter 113 of about 45 mm.

Figure 2A:
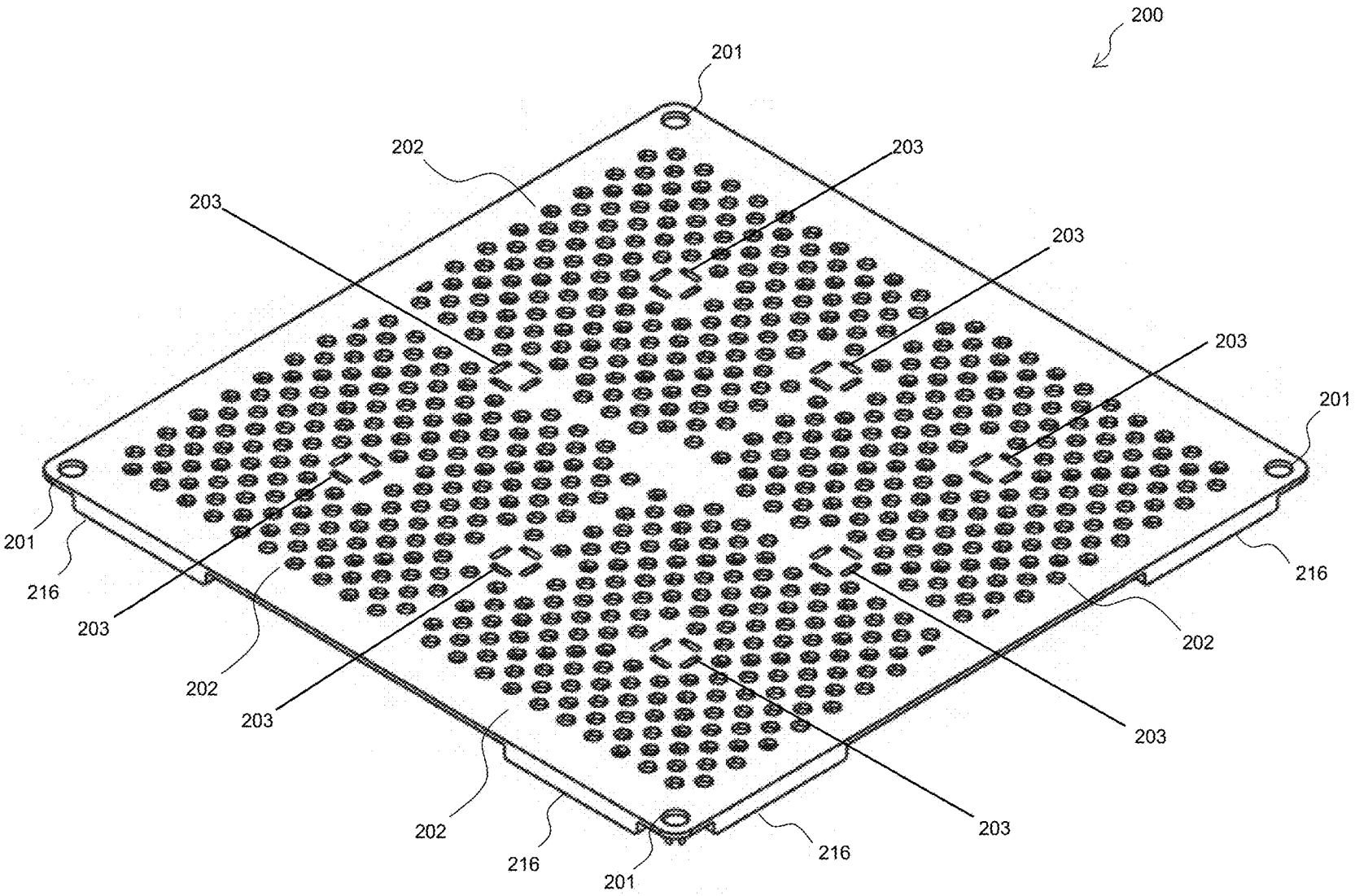
FIG. 2A shows a perspective view of a water storage lid according to some embodiments of the present disclosure.

FIG. 2A shows a perspective view of a water storage lid 200 according to some embodiments of the present disclosure. In some embodiments, the water storage lid 200 can include four corner openings 201, which can be used to accommodate the insertion of a wicking material to draw water from the bottom of the system to the top where it can be used to support plant growth. In addition, the water storage lid 200 can be perforated to allow for water to easily flow through into the storage unit compartment but maintain structural integrity sufficient to support a hardscape. In some embodiments, the water storage lid 200 can include patterns of perforations, such as the four quadrants 202, where each quadrant 202 includes a grid of perforations. Additional details of the perforations are discussed in relation to FIG. 2B. In addition, the water storage lid 200 includes a plurality of female connection mechanisms 203, which are configured to receive and attach to the male connection mechanisms 107 of water storage unit 100. Additional details of the female connection mechanism 203 are discussed in FIG. 2C. In some embodiments, the water storage lid 200 further includes a plurality of flaps 216 that assist in the connection to a water storage unit 100.

Figure 2B:
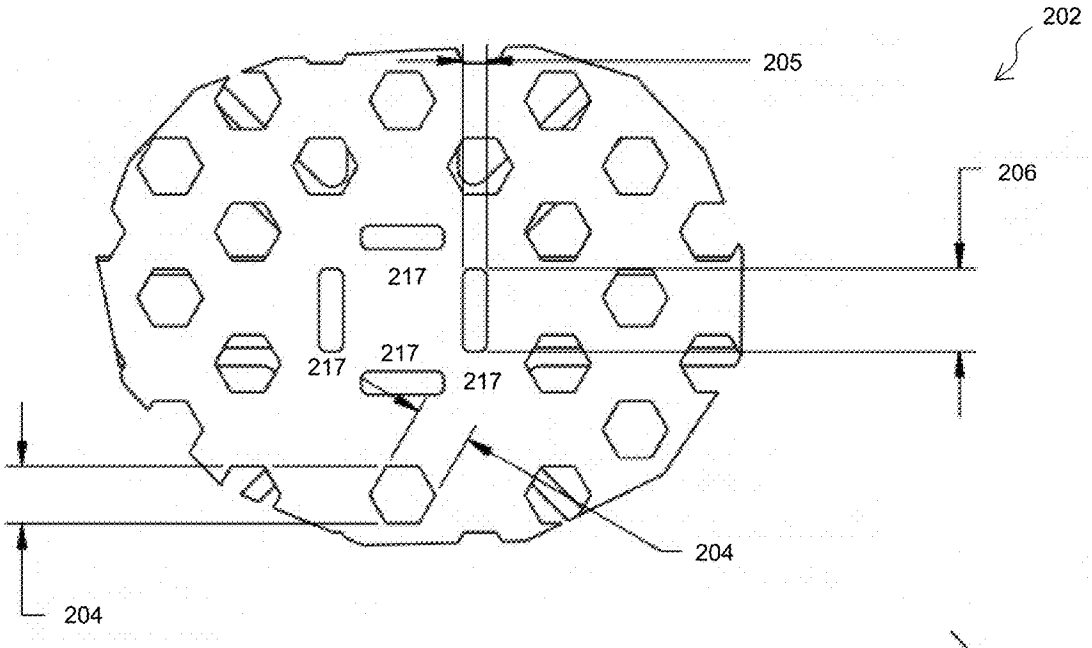
FIGS. 2B and 2C show perforations and a female connection mechanism of a water storage lid according to some embodiments of the present disclosure.
Figure 2C:
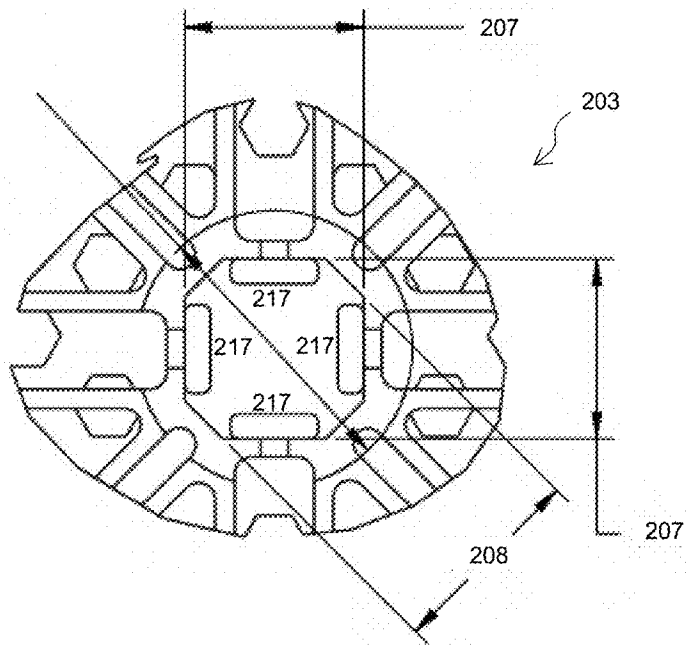

FIGS. 2B and 2C show perforations and a female connection mechanism of a water storage lid 200 according to some embodiments of the present disclosure. FIG. 2B is a zoomed-in view of a quadrant 202 of perforations from water storage lid 200. In some embodiments, the perforations can be hexagonally-shaped, although this is not limiting in nature and various shapes could be possible, such as a circle, square, octagon, etc. In FIG. 2B, where the perforations are hexagonal, the dimensions can include an equal height and width 204 of an 11 mm type hex. In addition, the female attachment mechanism 203 includes widths 207, which can be about 32.5 mm, although they are not required to be equal. In addition, the female attachment mechanism 203 include a diagonal width 208, which can be about 36.25 mm. Finally, the female attachment mechanism 203 includes four slots 217 which are configured to receive the prongs 114 of the male attachment mechanism 107. In some embodiments, the number of female attachment mechanisms 203 can correspond to the number of intersections of cross-bodies 103 in a water storage unit 100. In some embodiments, the slots can have a width 205 of about 4.64 mm and a length 206 of about 16 mm.

Figure 2D:
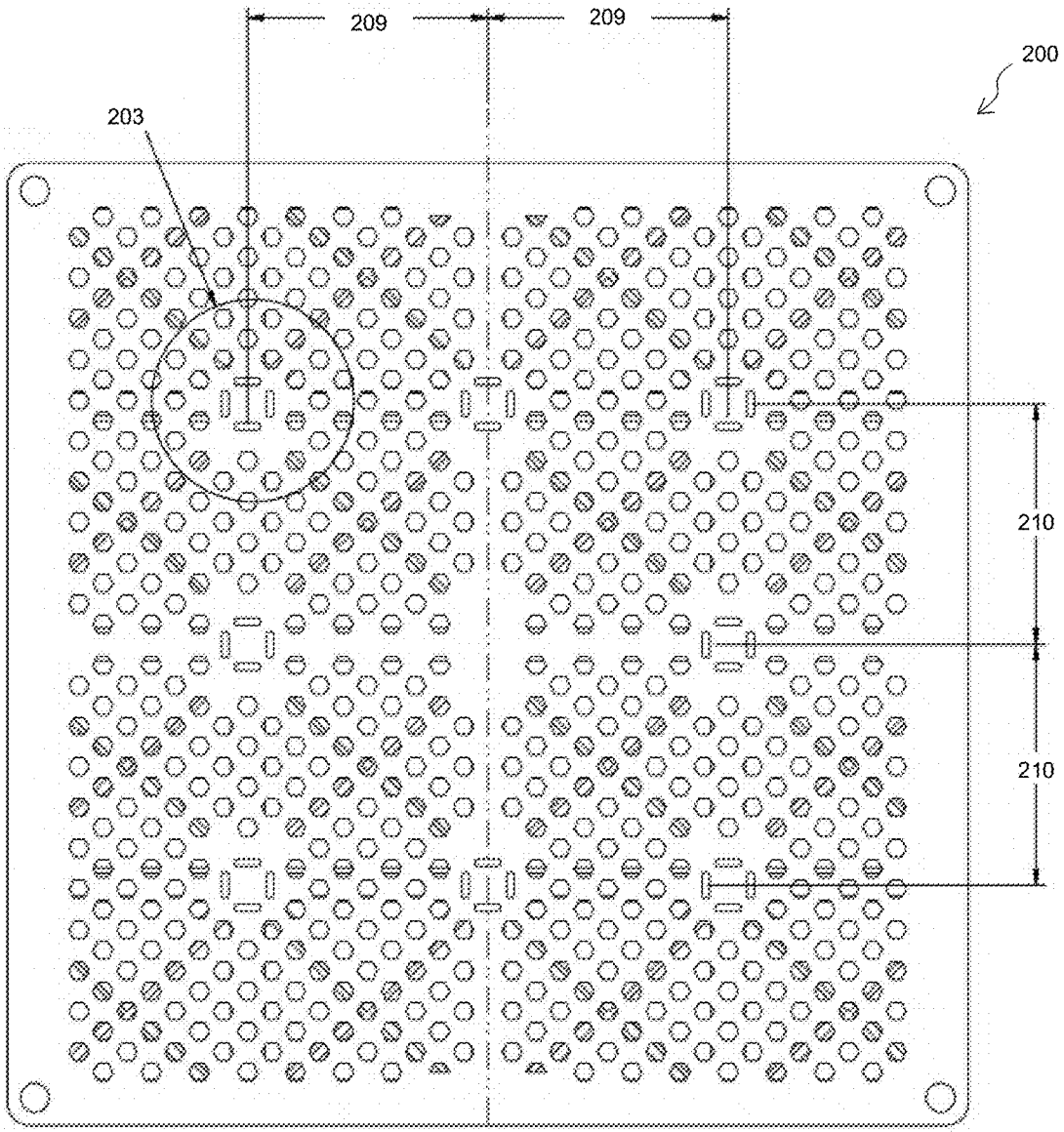
FIG. 2D shows a top view of a water storage lid according to some embodiments of the present disclosure.

FIG. 2D shows a top view of a water storage lid 200 according to some embodiments of the present disclosure. The top view illustrates the female attachment mechanisms 203. In addition, the water storage lid 200 includes distances 209 and 210 between the female attachment mechanisms 203. In some embodiments, the distances 209 and 210 can be about 150 mm.

Figure 2E:
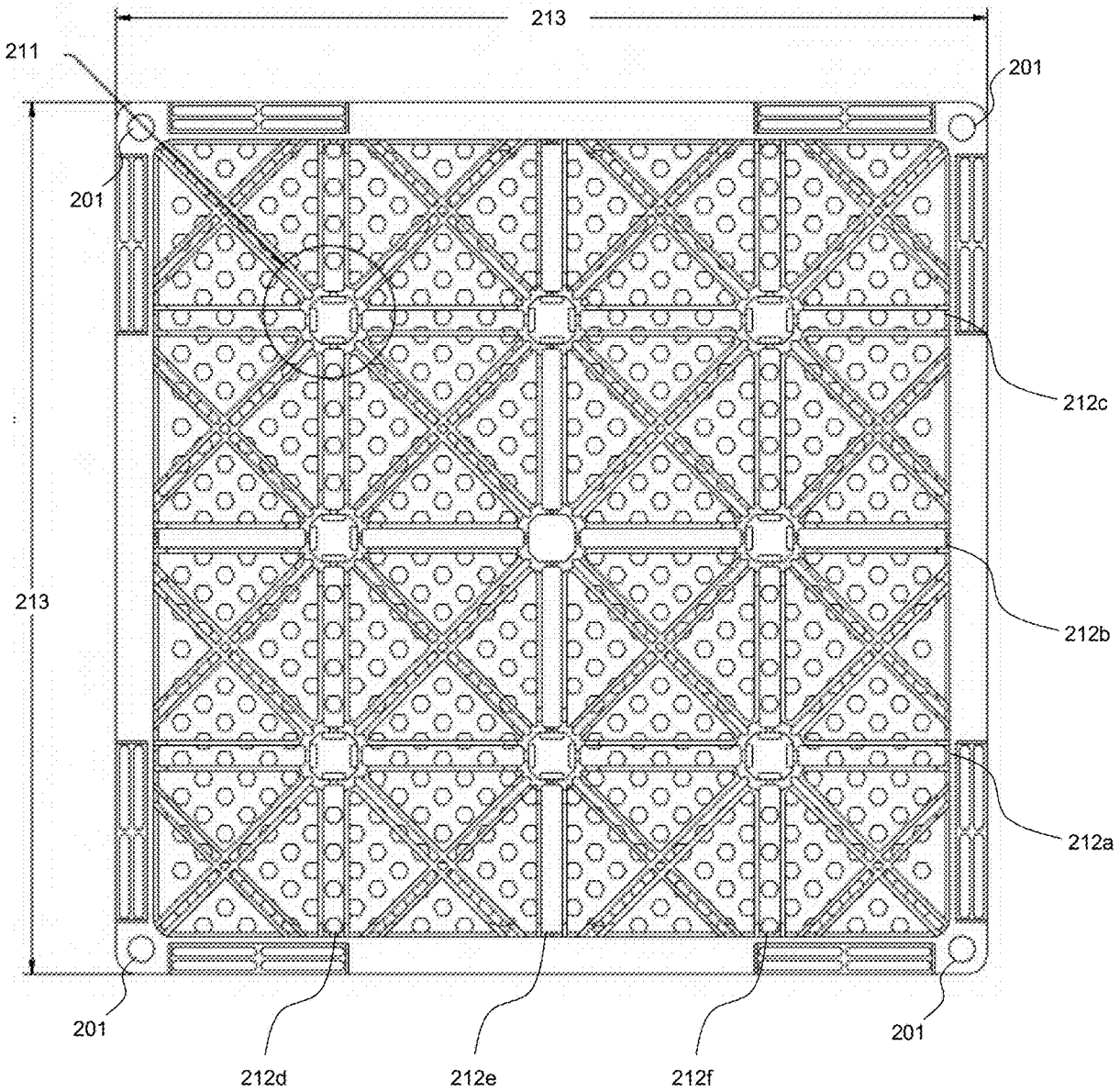
FIG. 2E shows a bottom view of a water storage lid according to some embodiments of the present disclosure.

FIG. 2E shows a bottom view of a water storage lid 200 according to some embodiments of the present disclosure. The bottom of the water storage lid 200 includes cross-beams 212 that can add structural integrity to the system. In addition, the cross-beams 212 can intersect at the bottom 211 of the female attachment mechanisms. In some embodiments, the width and length 213 of the water storage lid 200 can be the same and can be about 600 mm.

Figure 2F:
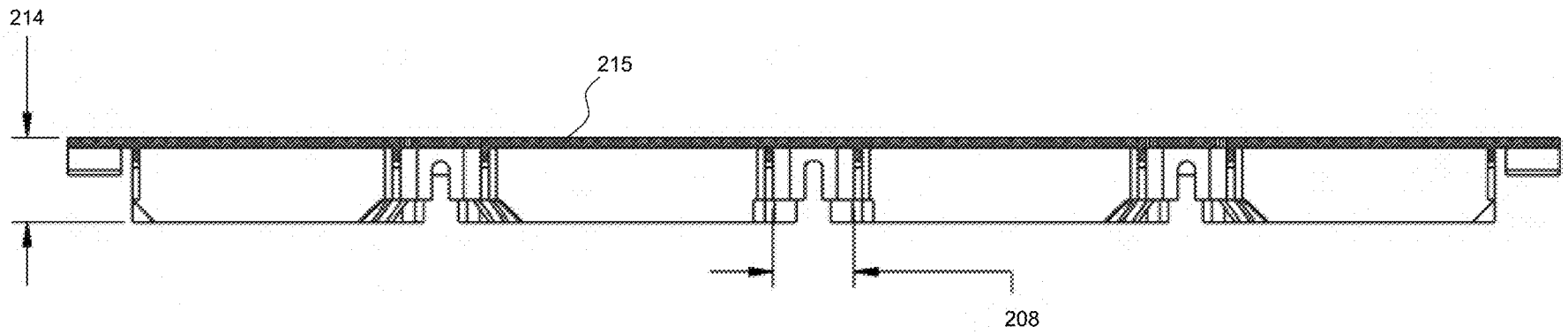
FIG. 2F shows a side view of a water storage lid according to some embodiments of the present disclosure.

FIG. 2F shows a side view of a water storage lid 200 according to some embodiments of the present disclosure. The water storage lid can include a top portion 215, which includes the various perforations and female attachment mechanisms 203 discussed in relation to FIGS. 2A-2E. In some embodiments, a width 208 of the female attachment mechanisms 203 can be about 32.5 mm. In addition, the overall thickness 214 of the water storage lid 200 can be about 34 mm.

Figure 3A:
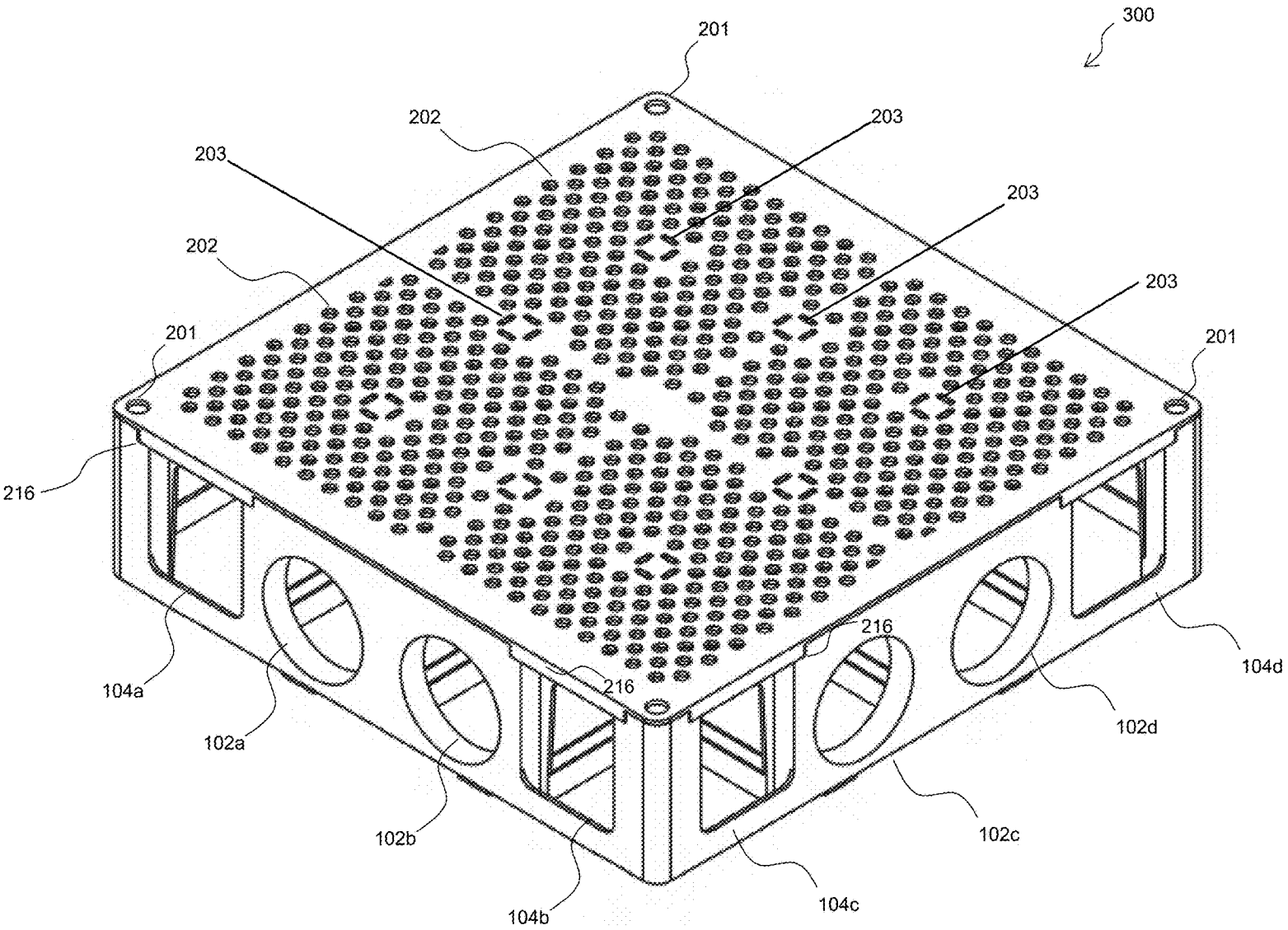
FIG. 3A shows a perspective view of a water storage unit and lid combination 300 according to some embodiments of the present disclosure.
Figure 3B:
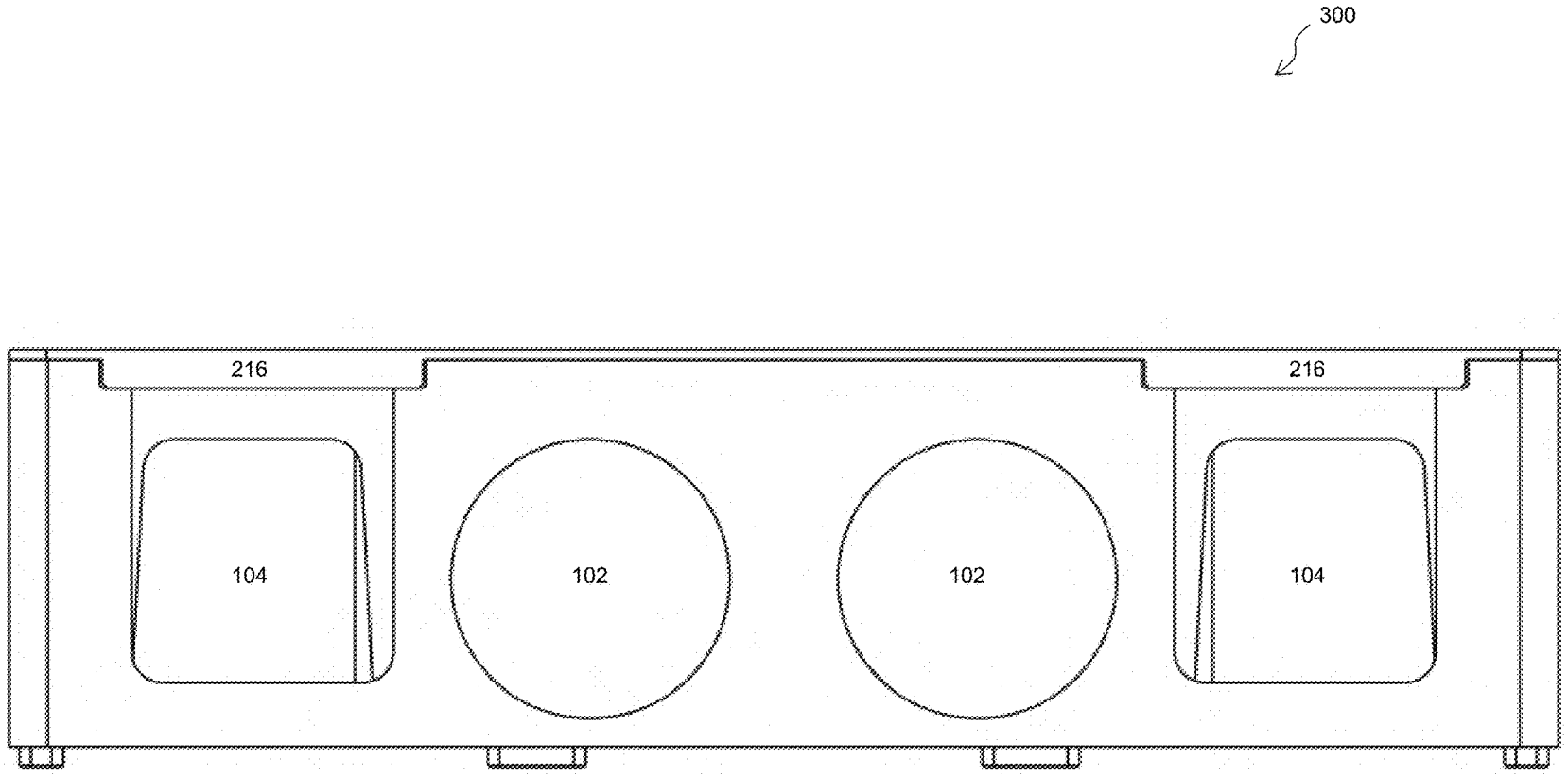
FIG. 3B shows a side view of a water storage unit and lid combination 300 according to some embodiments of the present disclosure.

FIG. 3A shows a perspective view of a water storage unit and lid combination 300 according to some embodiments of the present disclosure. The combination 300 includes a water storage unit 100 attached to a water storage lid 200, where the male attachment mechanisms 107 of the water storage unit 100 are connected to the female attachment mechanisms 203 of the water storage lid 200. In particular, the prongs 114 have been inserted into the slots 217 (not shown). In addition, the flaps 216 reside around the secondary openings 104 and prevent the water storage unit 100 from moving significantly in any direction, providing added stability to the combination 300. FIG. 3B shows a side view of a water storage unit and lid combination 300 according to some embodiments of the present disclosure. The flaps 216 hang over the top edge of the water storage unit 100, above the secondary openings 104.

Figure 4A:
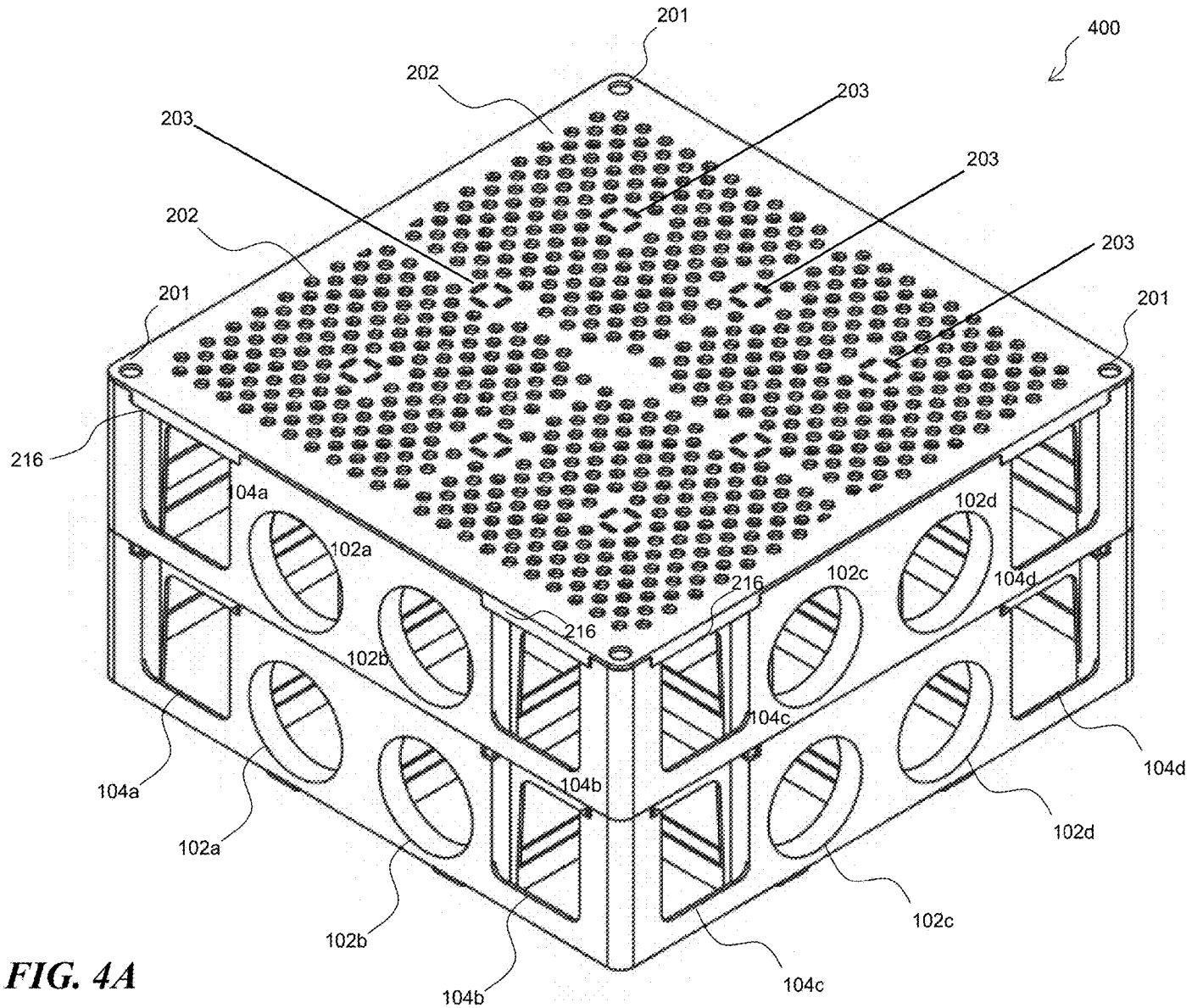
FIG. 4A shows a perspective view of a water storage unit assembly according to some embodiments of the present disclosure.
Figure 4B:
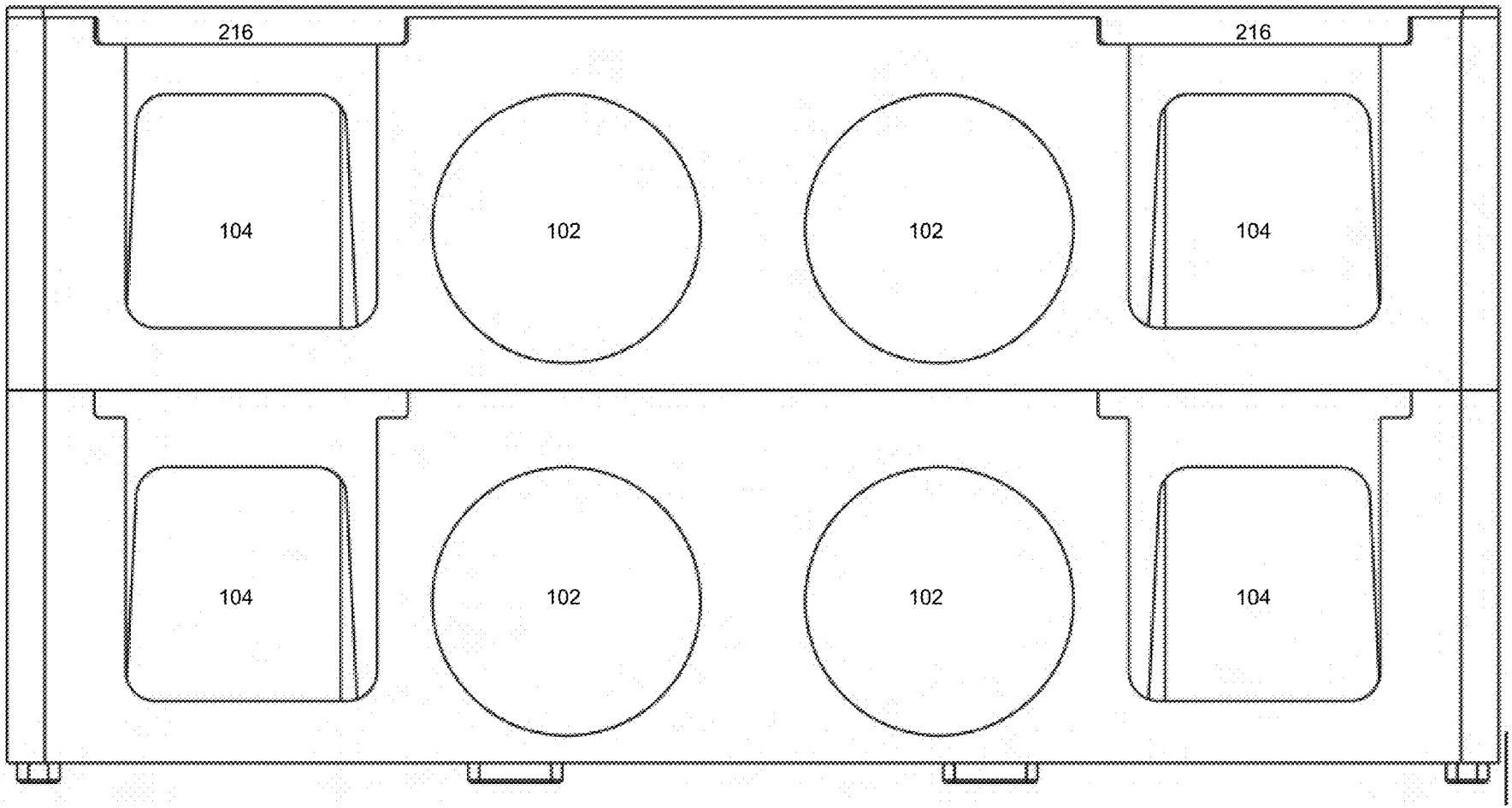
FIG. 4B shows a side view of a water storage unit assembly according to some embodiments of the present disclosure.

FIG. 4A shows a perspective view of a water storage unit assembly 400 according to some embodiments of the present disclosure. The water storage unit assembly 400 is an example of stacking two water storage units 100 on top of each other and covering the assembly with a water storage lid 200. The water storage lid 200 and the top water storage unit can be connected in the same manner as described in relation to FIG. 3A. In addition, the top and bottom water storage units are connected via a similar mechanism. FIG. 4B shows a side view of a water storage unit assembly 400 according to some embodiments of the present disclosure. The flaps 216 of the water storage lid 200 is aligned with both sets of secondary openings 104.

Figure 5A:
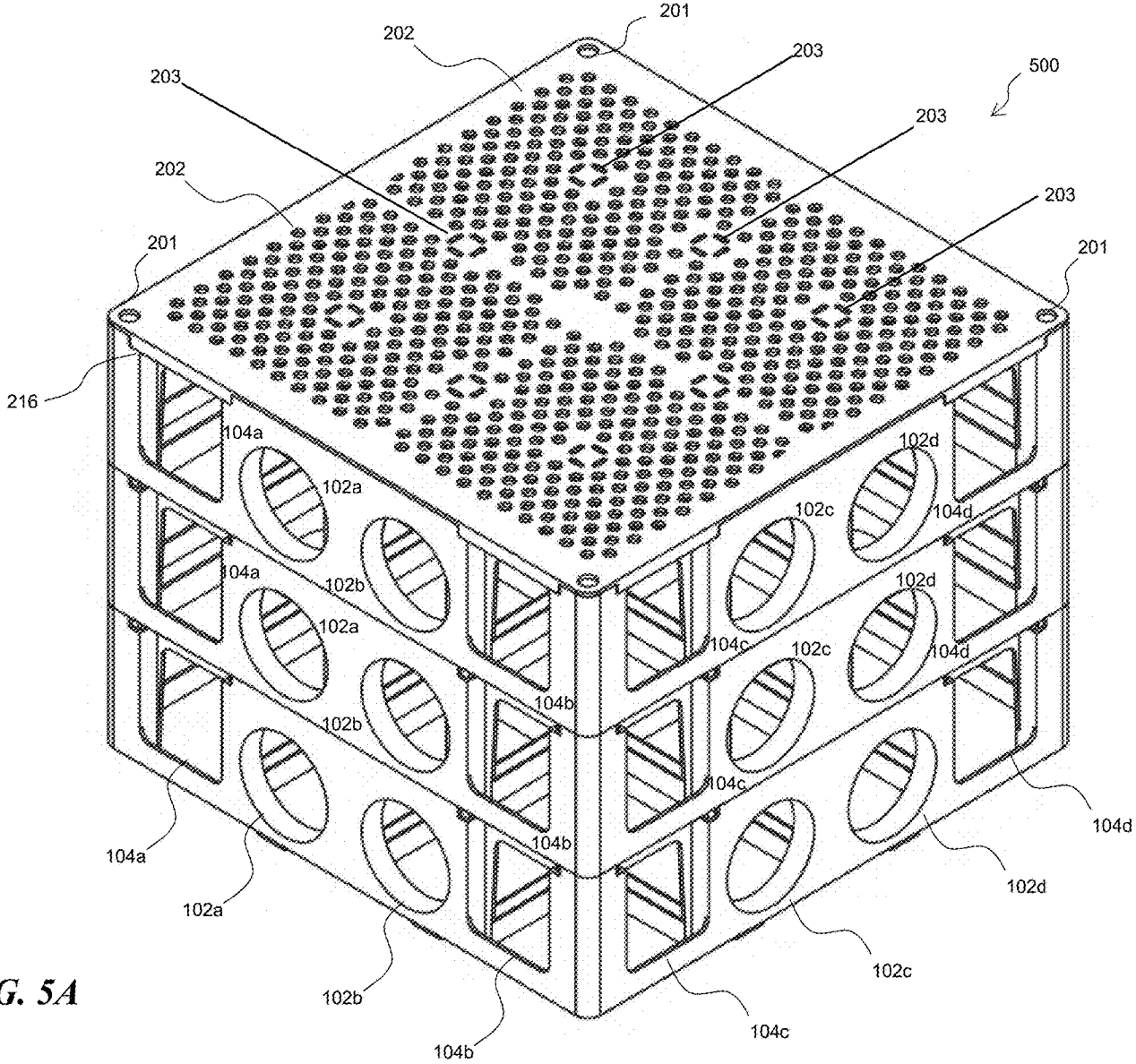
FIG. 5A shows a perspective view of another water storage unit assembly according to some embodiments of the present disclosure.
Figure 5B:
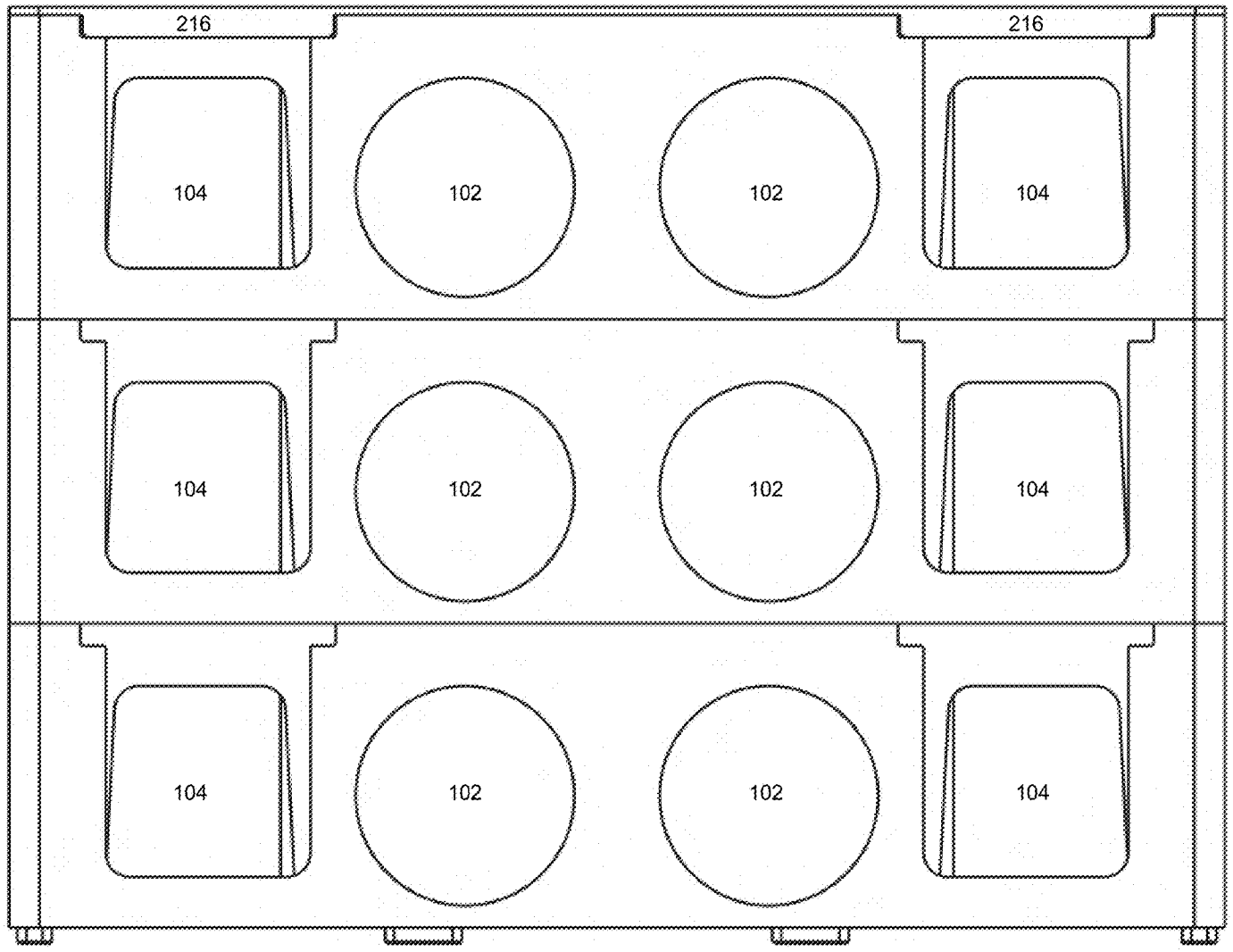
FIG. 5B shows a side view of another water storage unit assembly according to some embodiments of the present disclosure.

FIG. 5A shows a perspective view of another water storage unit assembly 500 according to some embodiments of the present disclosure. The water storage unit assembly 500 is an example of stacking three water storage units 100 on top of each other and covering the assembly with a water storage lid 200. The water storage lid 200 and the top water storage unit can be connected in the same manner as described in relation to FIG. 3A. In addition, the remaining water storage units 100 are connected via a similar mechanism. FIG. 5B shows a side view of another water storage unit assembly 500 according to some embodiments of the present disclosure. The flaps 216 of the water storage lid 200 is aligned with both sets of secondary openings 104.

Figure 6A:
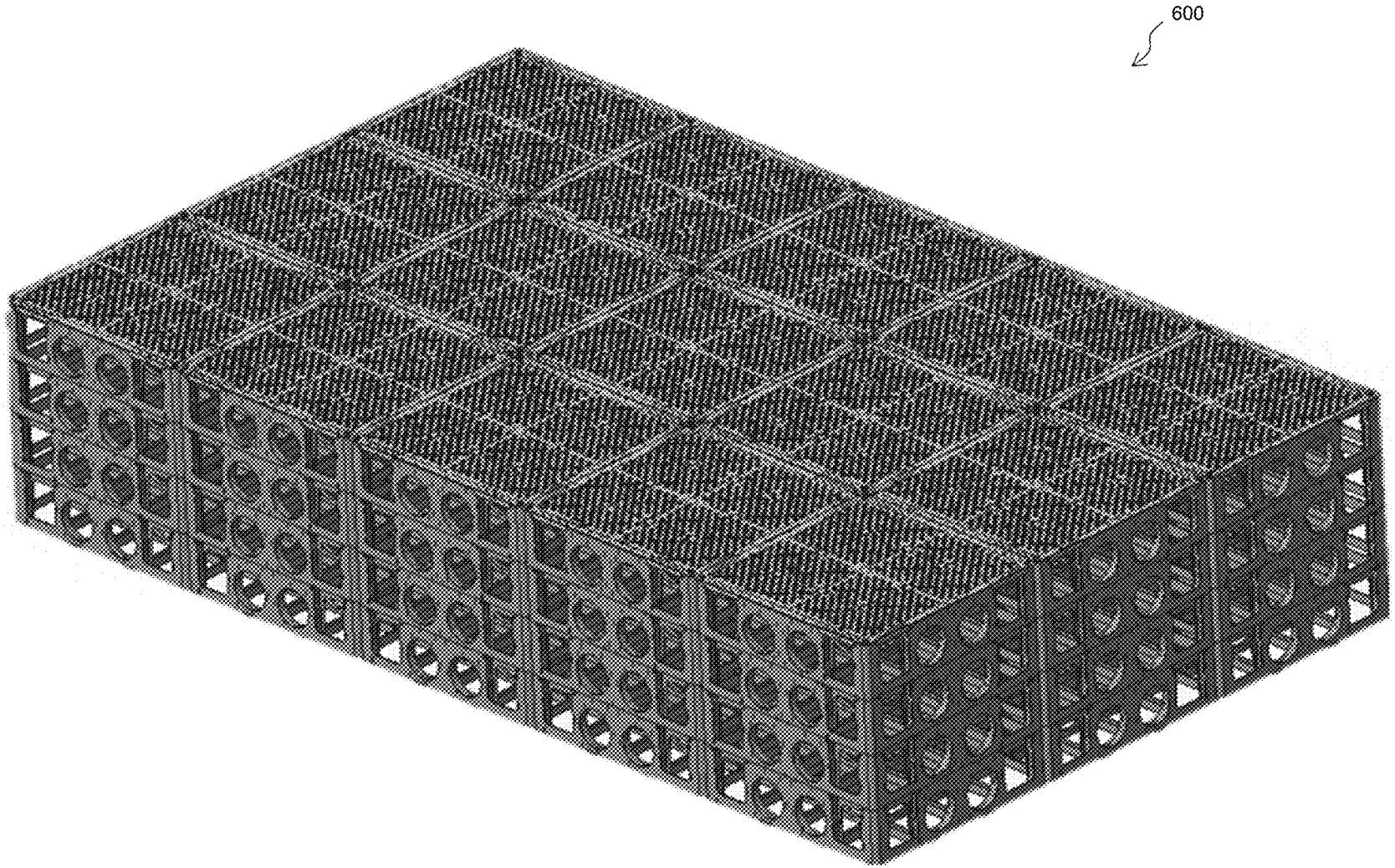
FIG. 6A shows a perspective view of another water storage unit assembly according to some embodiments of the present disclosure.
Figure 6B:
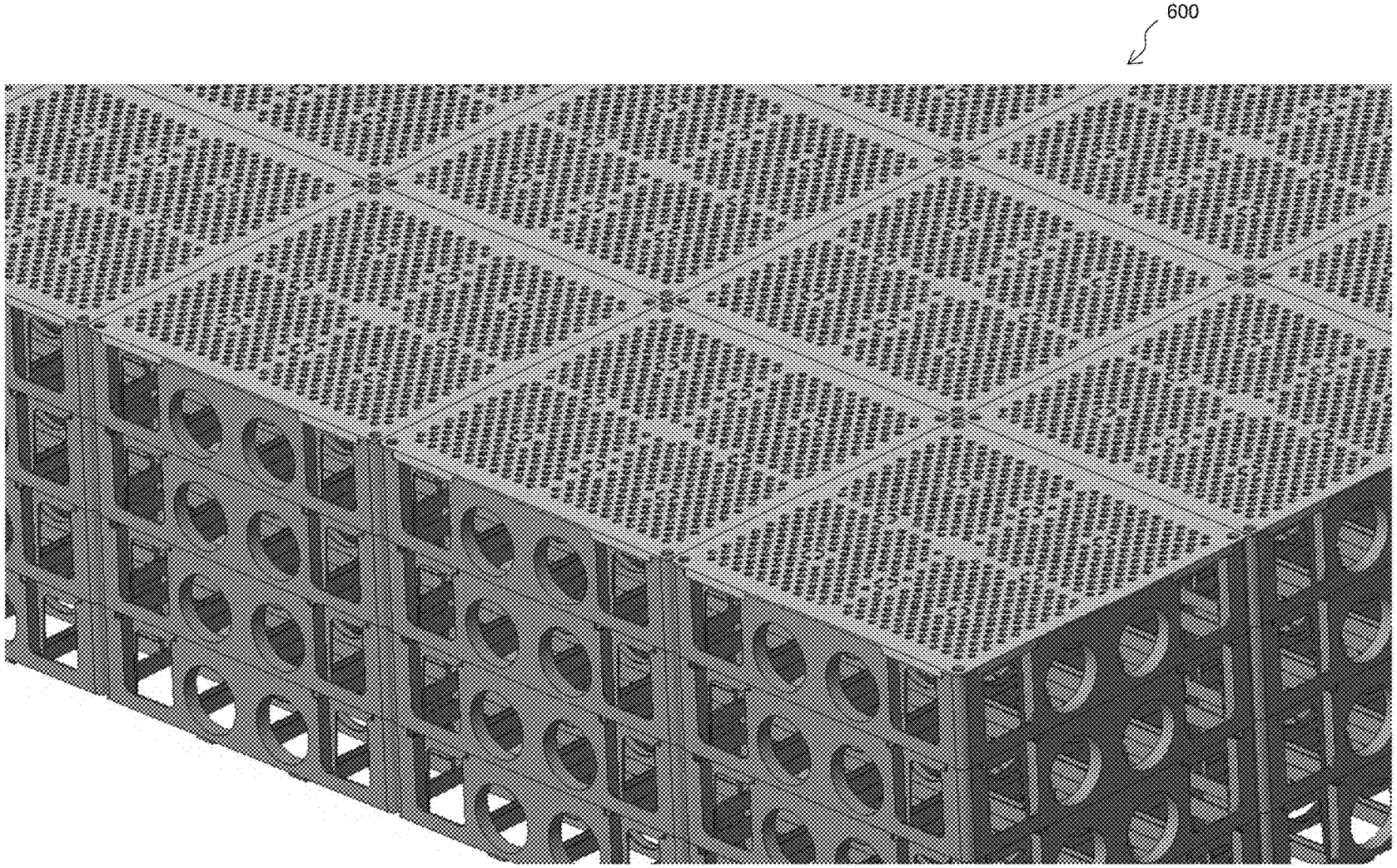
FIG. 6B shows a zoomed-in view of another water storage unit assembly according to some embodiments of the present disclosure.

FIG. 6A shows a perspective view of another water storage unit assembly 600 according to some embodiments of the present disclosure. The assembly 600 includes fifteen stacks of quadruple stacks of water storage units 100, each covered by a water storage lid 200. The assembly 600 therefore includes fifteen water storage lids 200 and sixty water storage units 100. FIG. 6B shows a zoomed-in view of another water storage unit assembly 600 according to some embodiments of the present disclosure.

Figure 7:
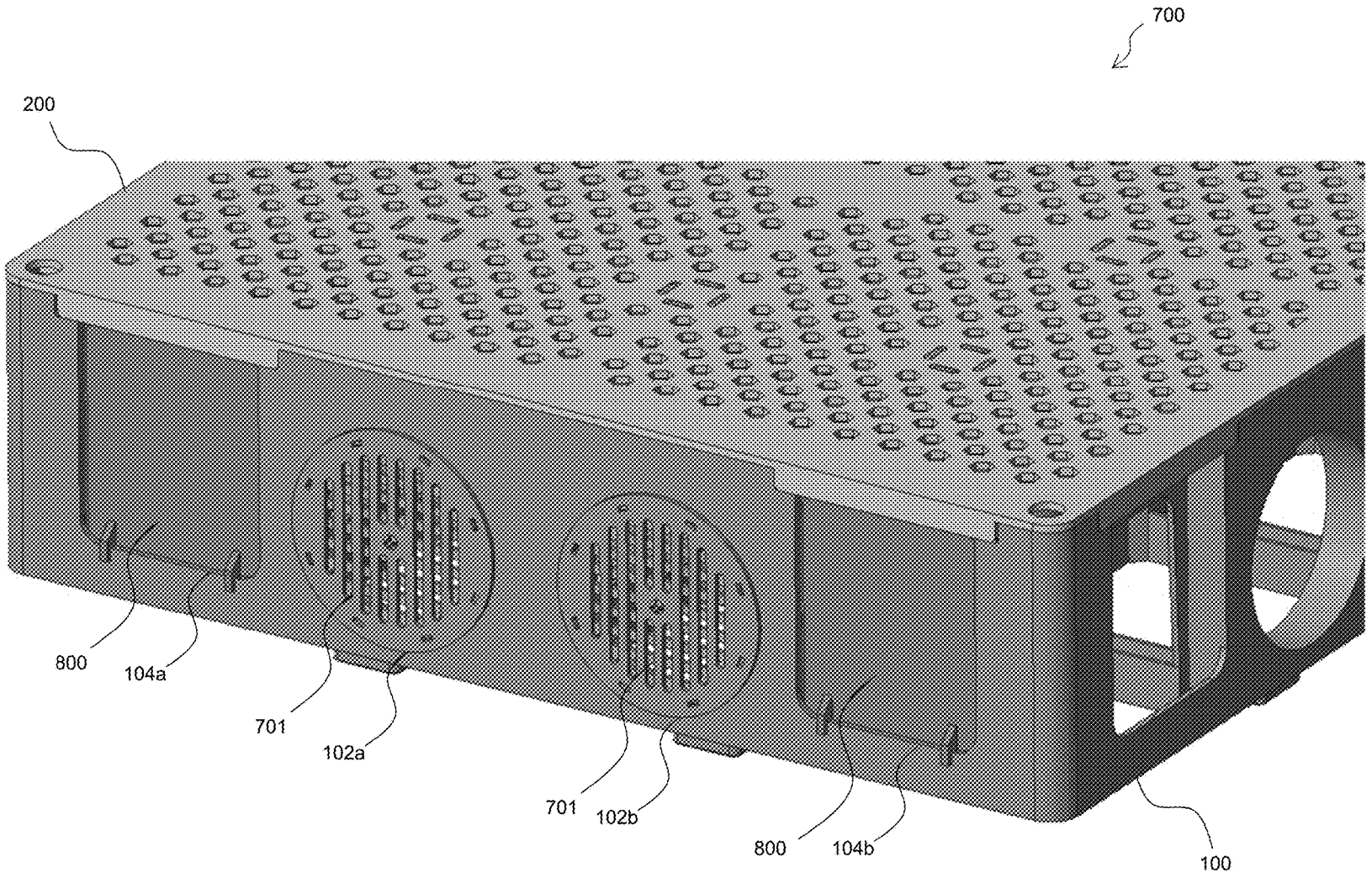
FIG. 7. shows a water storage unit assembly with flow restrictors according to some embodiments of the present disclosure.

FIG. 7. shows a water storage unit assembly 700 with flow restrictors according to some embodiments of the present disclosure. The water storage unit assembly 700 is similar to the assembly shown in FIG. 3A but including various flow restrictors. The water storage unit assembly 700 includes a water storage lid 200 connected to the top of a water storage unit 100. The assembly 700 further includes two flow restrictor assemblies 701 that have been inserted into and reside within openings 102*a* and 102*b*. The flow restrictor assemblies 701 can optionally be placed in the various openings 102 around the water storage unit 100 (not just the side shown in FIG. 7). Such flow restrictor assemblies 701 can add flow restrictions for the purpose of either slowing or redirecting water flow. Additional details with respect to the flow restrictor assemblies 701 are discussed in FIGS. 8A-8D. In addition, the water storage unit assembly 700 includes two secondary flow restrictors 800, which are inserted into and reside within the secondary openings 104*a* and 104*b*. Secondary flow restrictors 800 can fully block water flow or direct the water to flow through other openings. Additional details of the secondary flow restrictors 800 are discussed in FIG. 9.

Figure 8A:
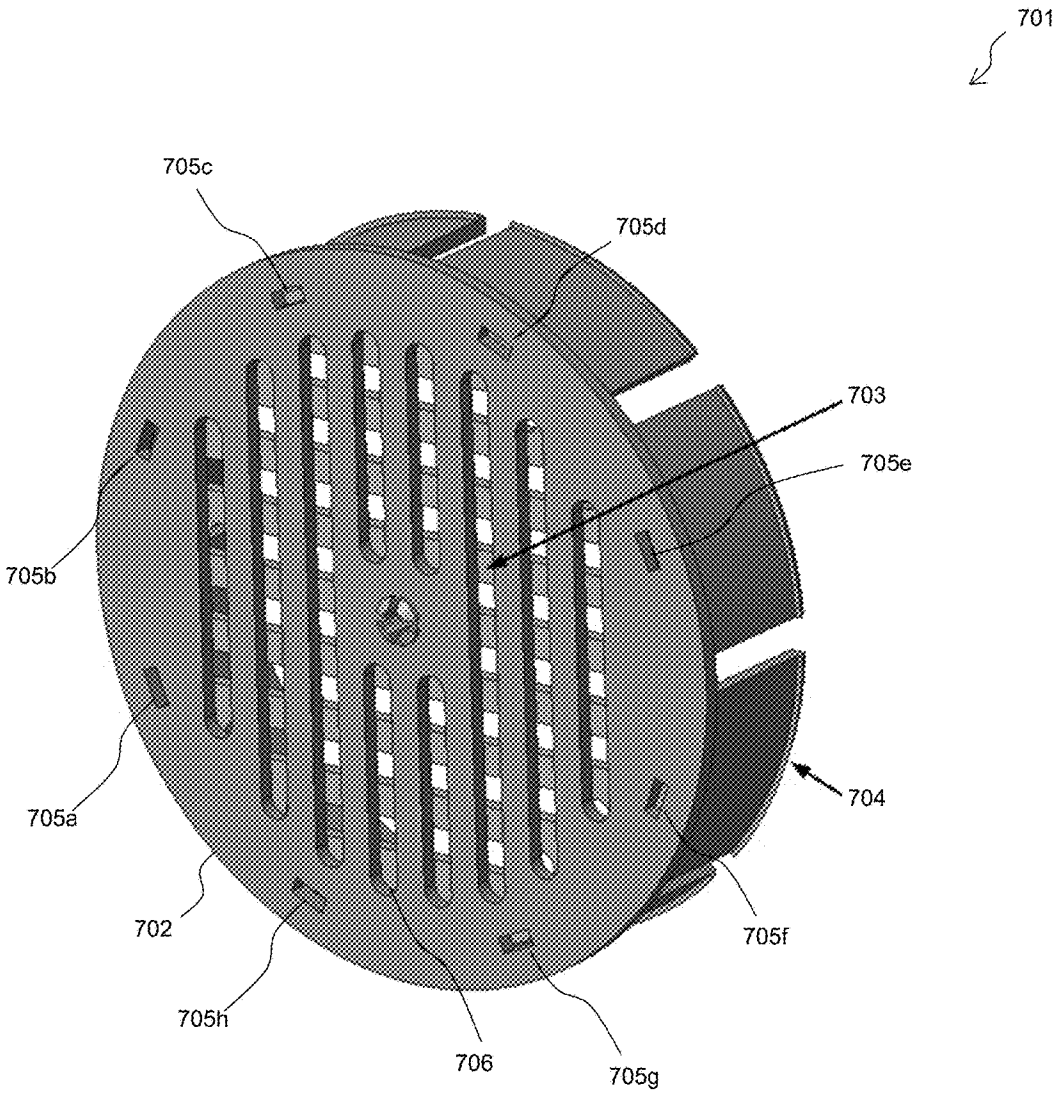
FIG. 8A shows a perspective view of a flow restrictor assembly according to some embodiments of the present disclosure.

FIG. 8A shows a perspective view of a flow restrictor assembly 701 according to some embodiments of the present disclosure. The flow restrictor assembly 701 includes a casing 702 and an aperture 703 that can be removably attached to the inside of the casing 702. In some embodiments, the aperture 703 is a rotatable aperture. Additional details of the aperture 703 are discussed in relation to FIGS. 8B-8D. In some embodiments, the casing 702 can include snap-in assembly features 704, which allow the flow restrictor assembly 701 to removably connect to (via snapping in) to a water storage unit 100 via an opening 102. In some embodiments, the casing 702 can further include a plurality of slits 705*a-h* (herein referred to as a "slit 705" generally or "slits 705" collectively). In some embodiments, the slits 705 can be equally spaced around the perimeter of the casing 702. The slits 705 are configured to receive a detent of the aperture 703 (not shown, see FIG. 8B) to facilitate their connection. Although the flow restrictor assembly 701 of FIG. 8A shows eight slits 705, this is not limiting and is merely exemplary in nature. In addition, the casing 702 can include a slot configuration 706. The slot configuration shown in FIG. 8A includes various vertical slots with curved ends, although the actual shape and arrangement of slots may vary based on the desired flow characteristics. In some embodiments, the flow restrictor assembly 701 has a diameter of about 108 mm and a thickness of about 20 mm. In some embodiments, each slot of the slot configuration 706 can have a width of about 5 mm.

Figure 8B:
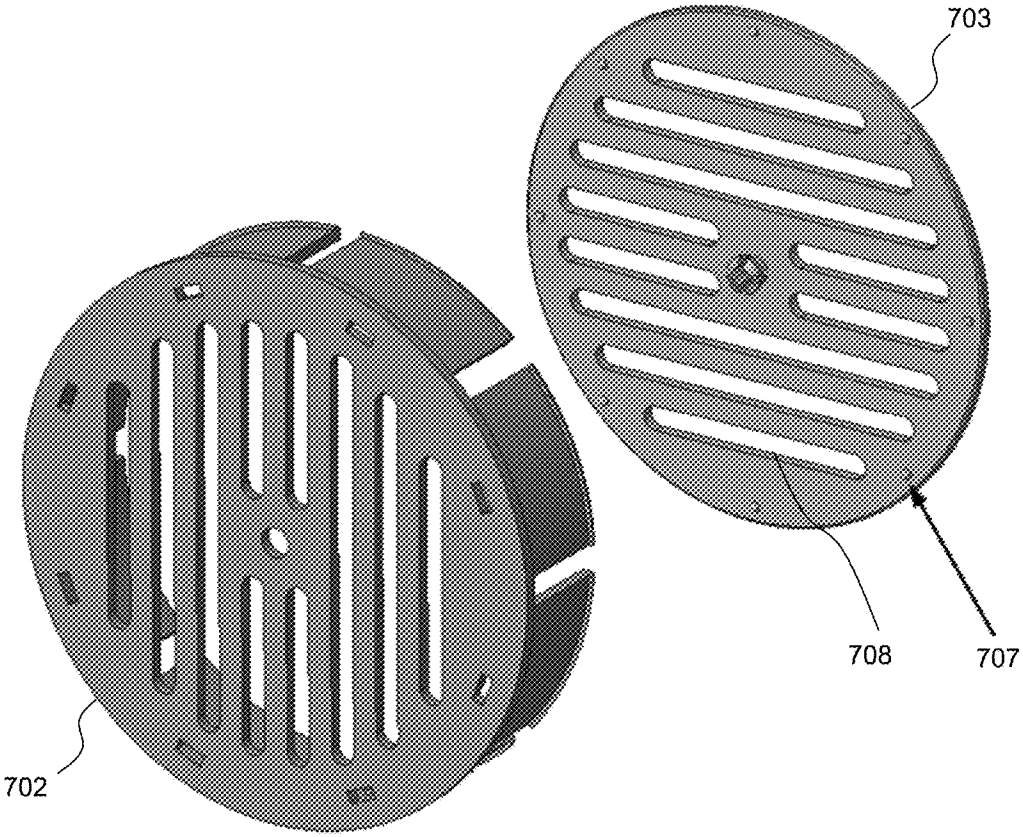
FIG. 8B shows an exploded view of a flow restrictor assembly according to some embodiments of the present disclosure.

FIG. 8B shows an exploded view of a flow restrictor assembly 701 according to some embodiments of the present disclosure. As discussed above, the flow restrictor assembly 701 includes a casing 702 and an aperture 703. In some embodiments, the aperture 703 includes a plurality of detents 707, which are configured to align with and enter the slits 705 of the casing 702 to facilitate their connection. In addition, the aperture 703 has a slot configuration 708. In some embodiments, the slot configuration 708 can be the same configuration as the slot configuration 706 of the casing 702. In addition, the aperture 703 can be rotatable within the casing 702 (see FIGS. 8C-8D below).

Figure 8C:
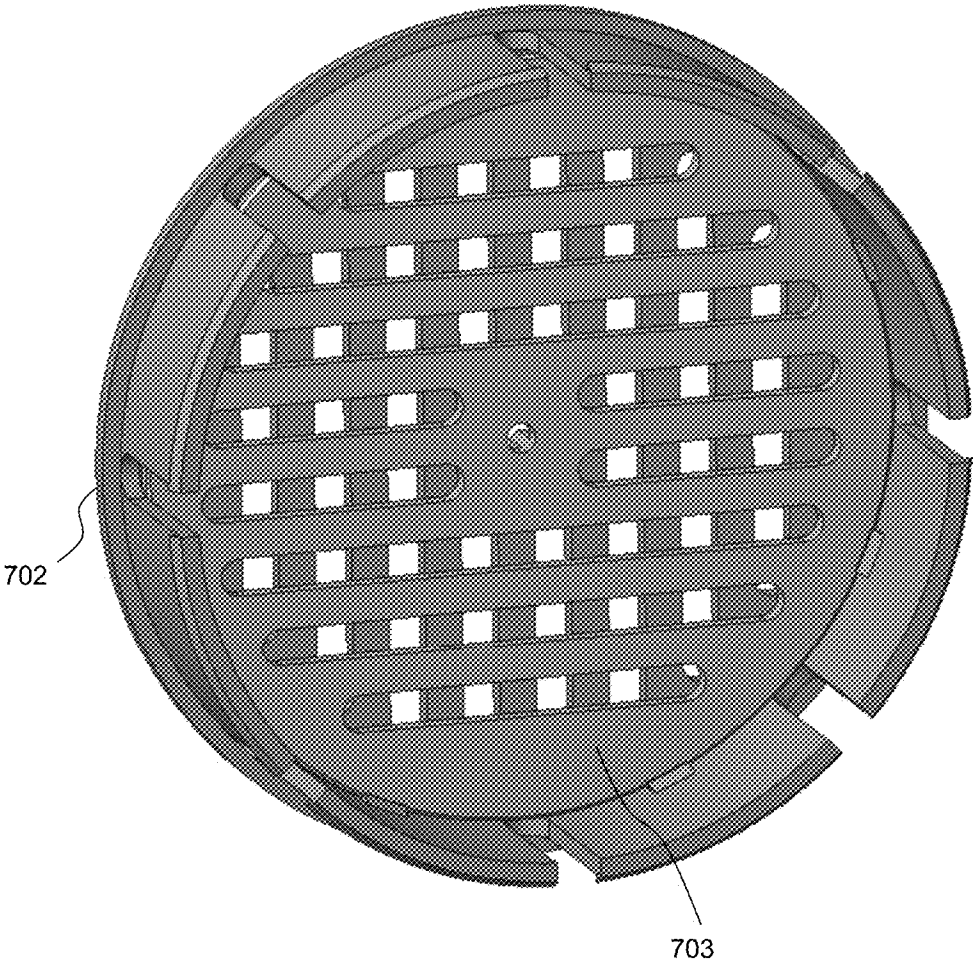
FIG. 8C shows a back perspective view of a first configuration of a flow restrictor assembly according to some embodiments of the present disclosure.

FIG. 8C shows a back perspective view of a first configuration of a flow restrictor assembly 701 according to some embodiments of the present disclosure. In this first configuration, the slots of the slot configuration 708 of the aperture 703 are perpendicular to the slots of the slot configuration 706 of the casing 702. This creates the smallest area of opening through the flow restrictor assembly 701 and thus allows the least amount of flow.

Figure 8D:
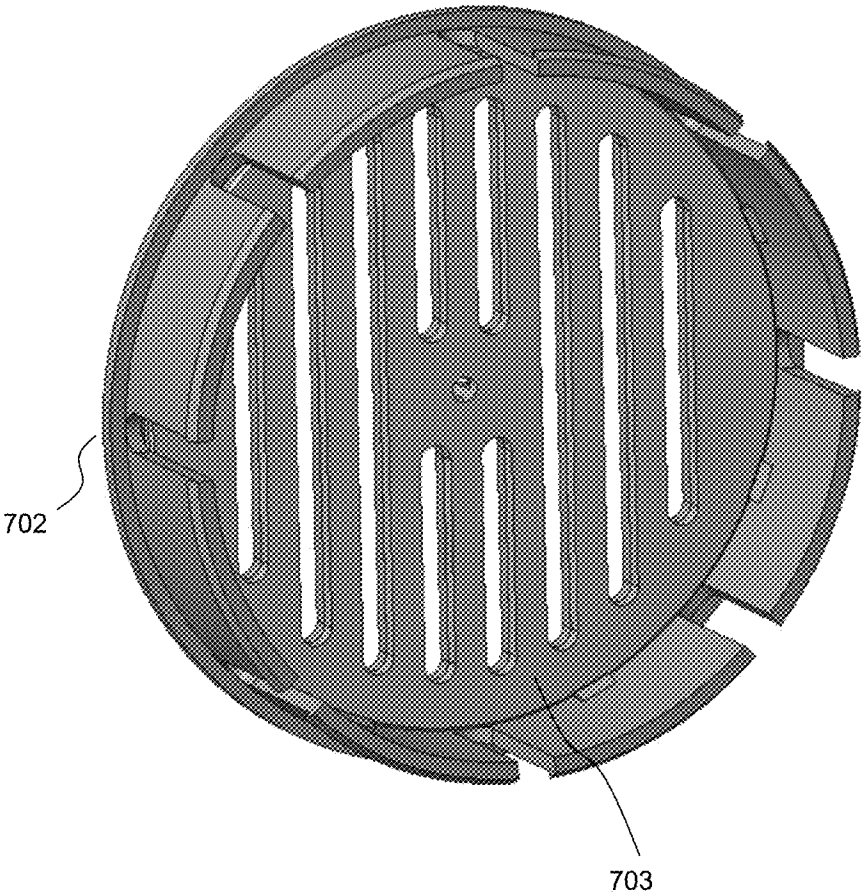
FIG. 8D shows a back perspective view of a second configuration of a flow restrictor assembly according to some embodiments of the present disclosure.

FIG. 8D shows a back perspective view of a second configuration of a flow restrictor assembly 701 according to some embodiments of the present disclosure. In this second configuration, the slots of the slot configuration 708 of the aperture 703 are parallel to and overlap the slots of the slot configuration 706 of the casing 702. This creates the largest area of opening through the flow restrictor assembly 701 and thus allows the greatest amount of flow.

In some embodiments, the rotation of the aperture 703 within the casing 702 can be controlled in-situ via a low voltage solenoid control mechanism.

Figure 9:
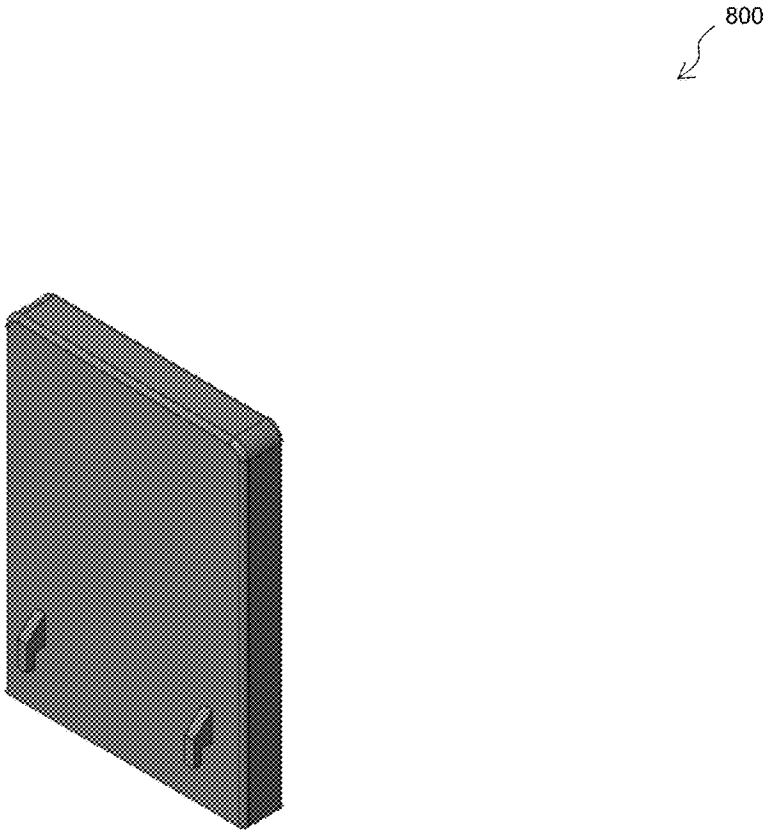
FIG. 9 shows a perspective view of another flow restrictor according to some embodiments of the present disclosure.

FIG. 9 shows a perspective view of another flow restrictor 800 according to some embodiments of the present disclosure. In some embodiments, the flow restrictor 800 can also be slotted (not shown). The flow restrictor 800 can have a height of about 139 mm, a width of about 101 mm, and a thickness of about 17.5 mm.

While various embodiments have been described above, it should be understood that they have been presented by way of example and not limitation. It will be apparent to persons skilled in the relevant art(s) that various changes in form and detail may be made therein without departing from the spirit and scope. In fact, after reading the above description, it will be apparent to one skilled in the relevant art(s) how to implement alternative embodiments. For example, other steps may be provided, or steps may be eliminated, from the described flows, and other components may be added to, or removed from, the described systems. Accordingly, other implementations are within the scope of the following claims.

In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

The invention claimed is:

1. A water storage system comprising:

a water storage unit comprising:

an outer shell with a first side comprising a first plurality of openings and a second side adjacent the first side comprising a second plurality of openings, each of first and second plurality of openings comprising only four openings, two of the four openings being inner openings and the remaining two being outer openings, each outer opening residing between a respective inner opening and a corner of the outer shell;

a first set of cross-bodies spanning a width of the outer shell; and a second set of cross-bodies spanning a length of the outer shell and intersecting the first set of cross-bodies; and a plurality of vertical pillars, the pillars supporting intersection points of the first and second sets of cross-bodies; and a water storage lid configured to be attached to the water storage unit, the water storage lid comprising:

a first plurality of flaps extending downward from the water storage lid and covering a portion of the first side of the outer shell; and a second plurality of flaps extending downward from the water storage lid and covering a portion of the second side of the outer shell wherein each flap at least partially aligns with a respective outer opening of the two outer openings, wherein the water storage unit is configured to connect to a top of a second water storage unit via each of the plurality of vertical pillars directly connecting to and contacting a second plurality of vertical pillars of the second water storage unit.

2. The water storage system of claim 1, wherein the outer shell comprises:

a third side comprising a third plurality of openings, wherein the third side is opposite the first side and the third plurality of openings are aligned with the first plurality of openings; and a fourth side comprising a fourth plurality of openings, wherein the fourth side is opposite the second side and the fourth plurality of openings are aligned with the second plurality of openings.

3. The water storage system of claim 1, wherein at least one of the first side or second side comprises a plurality of secondary openings, wherein each secondary opening is between an opening and a corner of the outer shell.

4. The water storage system of claim 3, wherein each of the plurality of secondary openings are approximately rectangular in shape.

5. The water storage system of claim 1, wherein the water storage lid comprises a plurality of perforations.

6. The water storage system of claim 5, wherein each of the plurality of perforations are hexagonally shaped.

7. The water storage system of claim 1, wherein each intersection point comprises a male connection mechanism.

8. The water storage system of claim 7, wherein the male connection mechanism comprises a plurality of prongs.

9. The water storage system of claim 8, wherein the male connection mechanism comprises four prongs.

10. The water storage system of claim 8, wherein the lid comprises a plurality of female connection mechanisms.

11. The water storage system of claim 10, wherein the female connection mechanisms are aligned with the male connection mechanisms.

12. The water storage system of claim 10, wherein each of the female connection mechanisms comprises a plurality of slots, each slot being configured to receive a prong of a respective male connection mechanism.

13. The water storage system of claim 1, wherein each of the first and second pluralities of openings is circular.

14. The water storage system of claim 13, wherein each of the first and second pluralities of openings has a diameter of about 128 mm.

15. The water storage system of claim 1 comprises at least one flow restrictor configured to partially block an opening.

16. The water storage system of claim 15, wherein the at least one flow restrictor is slotted.

17. A water storage system comprising:

a water storage unit comprising:

an outer shell with a first side comprising a first plurality of openings and a second side adjacent the first side comprising a second plurality of openings, each of first and second plurality of openings comprising only four openings, two of the four openings being inner openings and the remaining two being outer openings, each outer opening residing between a respective inner opening and a corner of the outer shell;

a first set of cross-bodies spanning a width of the outer shell; and a second set of cross-bodies spanning a length of the outer shell and intersecting the first set of cross-bodies;

a water storage lid configured to be attached to the water storage unit; and at least one flow restrictor configured to partially block an opening of the first and second plurality of openings, the at least one flow restrictor comprising:

a casing comprising a plurality of slots; and an aperture configured to rotate within the casing and comprising a second plurality of slots;

wherein, in a first rotatable state, the first and second plurality of slots align to enable a first amount of flow; and wherein, in a second rotatable state, the casing covers at least a portion of the second plurality of slots to enable a second amount of flow less than the first amount of flow.

* * * * *